United States Patent [19]

Sarnes

[11] 4,145,798

[45] Mar. 27, 1979

[54] FORGING RECESSED CONFIGURATIONS ON A BODY MEMBER

[75] Inventor: Myron C. Sarnes, Northville, Mich.

[73] Assignee: Federal-Mogul Corporation, Southfield, Mich.

[21] Appl. No.: 844,361

[22] Filed: Oct. 21, 1977

[51] Int. Cl.[2] ..... B21K 1/04

[52] U.S. Cl. ..... 29/148.4 R; 75/200; 75/208 R; 29/420.5; 29/423; 29/149.5 PM; 148/126; 148/12 F; 148/16.5

[58] Field of Search ..... 29/423, 148.4 R, 149.5 PM, 29/420.5, 420; 75/200, 226, 208 R, 211

[56] References Cited

U.S. PATENT DOCUMENTS

| | | | |
|---|---|---|---|
| 2,050,298 | 8/1936 | Everett | 29/423 UX |
| 3,390,564 | 7/1968 | Syre et al. | 29/423 X |
| 3,761,257 | 9/1973 | Dunn | 29/420.5 |
| 3,837,068 | 9/1974 | Dunn | 29/420.5 |
| 3,992,763 | 11/1976 | Haynie et al. | 29/420.5 |
| 4,002,471 | 1/1977 | Sarnes et al. | 75/200 |

FOREIGN PATENT DOCUMENTS

| | | | |
|---|---|---|---|
| 2535155 | 2/1976 | Fed. Rep. of Germany | 29/148.4 R |

*Primary Examiner*—C. W. Lanham
*Assistant Examiner*—V. K. Rising
*Attorney, Agent, or Firm*—Robert F. Hess

[57] ABSTRACT

A novel and improved method of forging preselected recessed surfaces in a member is disclosed which comprises the steps of adding a suitable lubricant material to at least a slave or primary preform member wherein the lubricant material is sufficient to prevent welding between the noted preforms during the forging operation. Moreover, the method envisions the step of joining the slave preform to the primary body preform member, followed by forging the joined together preforms such that the primary preform member is deformed to an extent generally complementary to a portion of the configuration of the slave preform, such that the forged primary preform has formed therein a shaped recess generally complementary to at least a portion of the configuration of the slave preform. It is contemplated that the forged slave and primary preforms are quenched subsequent to forging. Thereafter, the method contemplates removing the quenched slave preform from the primary preform.

28 Claims, 19 Drawing Figures

FORGING RECESSED CONFIGURATIONS ON A BODY MEMBER

BACKGROUND OF THE INVENTION

1. Field of the Invention

In general, this particular invention relates to the forging of metal articles having predetermined shapes. More specifically, however, the present invention relates to a novel and improved method of forging preselected recessed configurations in a body member by forging a slave preform and the body member, and quenching such slave preform after the forging to facilitate removal thereof.

2. Brief Description of the Prior Art

Present day forging methods are unable to satisfactorily forge either internally or externally constructed generally radial recesses on members, such as the type found on inner bearing cone members, or other conventional inner and outer bearing race members. It has been determined that the difficulty encountered in the formation of such recesses was due to conventional forging techniques. In particular, the external or internal recesses would lock on the die wall or core rod wall, respectively. Various techniques exist, however, in industry for forming such recesses. One standard approach for use in the formation of such bearing cones and races includes conventional machining steps of appropriate metal blanks so as to correspondingly form a continuously smooth and recessed surface. While this particular practice has been followed, it nevertheless prevents several significant shortcomings. For instance, one substantial drawback associated with machining is that it inevitably results in additional costs. These cost increases include not only that which results from high scrap rates, but also the additional heat treatment necessary following machining in order to obtain the necessary case hardness and case depth.

Moreover, it should be pointed that the the field of forming bearing components is competitive and there is somewhat of a narrow or small profit margin associated with the production of such bearing elements. As a consequence thereof, it will, of course, be appreciated that even slight savings in cost render such bearing components more desirable from a cost standpoint.

From the preceding considerations, it is quite apparent that the formation of external or internal recesses on these bearing components, especially of the powdered metal type using the conventional machining approach, is complicated and are relatively higher in cost as well as require added time and labor.

For the reasons enumerated above, it is difficult and time-consuming to accurately form each bearing component. The prior art is absent a reliable and accurate technique enabling the formation of conventional bearing components without the noted drawbacks.

Additionally, the state of the art is absent not only processes enabling even more economical manufacture of large numbers of inner or outer bearing race elements having continuously smooth recessed surfaces, but also enabling the surfaces of case hardened powdered metal bearing parts to be formed in a manner without impairing the protection provided by case hardening.

SUMMARY OF THE INVENTION

Accordingly it is an object of this invention to overcome the heretofore noted prior art failings by being able to forge internal recessed configurations in a member, especially a body member for use in the construction of bearing components.

Briefly, in accordance with the principles of the present invention, there is disclosed a novel and improved method of forging preselected recessed surfaces in a member comprising the steps of adding a suitable lubricant material to at least a slave or primary preform member wherein the lubricant material is sufficient to prevent welding between the noted preforms during the forging operation. Such invention envisions joining the slave preform to the primary body preform member followed by forging the joined together preforms such that the primary preform member is deformed to an extent generally complementary to a portion of the configuration of the slave preform, such that the forged primary preform has formed therein a shaped recess generally complementary to at least a portion of the slave preform. The forged slave and primary preforms are then quenched. Thereafter, the method contemplates removing the slave from the recess of the primary preform.

In a preferred embodiment, the foregoing method envisions use of powder metal primary and slave preform members wherein the slave preform is made of a quench crackable material and the forged slave and primary preforms are quenched to thereby enable the slave preform to quench crack. The quench cracking thereby facilitates easy removal from the formed recess in the primary preform.

BRIEF DESCRIPTION OF THE DRAWINGS

The above and other objects, features and advantages of the present invention will become readily apparent upon reading a detailed description thereof when viewed in conjunction with the accompanying drawings wherein like reference numerals indicate like structure throughout the several views.

DETAILED DESCRIPTION

Although the succeeding description will be primarily directed to the forging of conventional inner and outer bearing race members, as well as cone-shaped bearing members, it will be understood that other types of articles may be suitably forged, particularly whenever it is desired to have the forged articles with an internal or external recess. As will be pointed out below, the forged bearing members with preselected generally axial recesses are to be made from conventional powdered metallurgical materials. It is contemplated by this invention that the formation of the axial recess be accomplished by forging together an appropriately sized and configured primary preform member 10 with an appropriately sized and configured slave preform member 12. The particular significance of such slave preform will be afterwards more completely described.

Figure 1A:
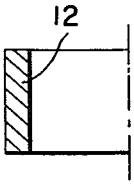
FIG. 1A is a partial cross-sectional view of a generally annular slave preform member embodying the principles of the present invention.

In particular, reference is made to FIGS. 1A–1F. As shown, in schematic form, there is illustrated a preferred sequence of operational steps which collectively serve to form inner bearing race member 14 (FIG. 1G) having an externally oriented recess 16 which will form a bearing raceway. FIG. 1A denotes a portion of slave preform 12 and insofar as this embodiment is directed to fabrication of cylindrical inner bearing race member 14 (FIG. 1G), it will be appreciated that slave preform 12 takes the configuration of a generally annular ring. The ring-shaped slave preform 12, as will be described, is for purposes of facilitating formation of the inner bearing race member 14 with a continuously smooth and circumferential raceway 16 in a single forging step. The slave preform 12, although not actually shown in this particular embodiment, can be formed with a plurality of internal or external grooves, such as of the kind depicted in FIG. 2A. The grooves can be suitably formed on the radially inner or outer surfaces of the slave preform on the surface opposite that which is complementary to the surface to be formed on the primary preform. The grooves advantageously facilitate quench cracking of the slave preform 12 which thereby enhances subsequent removal of the slave preform after forging.

Slave preform 12 is a briquetted powdered metal component. While the present invention envisions that several materials other than powdered metal can be used in fabrication of such a slave preform, it has been determined that powdered metal is preferred. In one embodiment, the invention envisions application of an iron powder having a relatively high amount of carbon added thereto. Alternatively, there need not be any carbon added. Typically, whatever carbon is added, however, generally takes the form of graphite. For instance, the amount of carbon, by weight, may range from about 0.0 percent to relatively high amounts in the order of 1.0 percent by weight. Whenever relatively high amounts of carbon are added, such as above 0. percent by weight, such facilitates the quench cracking of the slave preform 12.

The iron powder and carbon, in the form of graphite, are suitably blended and then pressed into a low-density, semi-finished slave preform 12 or briquette. If, for instance, the iron powder has 0.0 percent carbon, the briquetted slave preform 12 should be sintered, after briquetting, in a decarburizing atmosphere. On the other hand, whenever 1.0 percent carbon, by weight, is added to the iron powder, the briquetted slave preform 12 should be sintered in a carburizing atmosphere. The sequential briquetting and sintering operations, above noted, are known procedures performed by any suitable and conventional apparatus on powder metal parts. Since such operations do not, per se, form an aspect of this invention, a detailed description thereof will be dispensed with. It will be mentioned, however, that the reason the 0.0 percent carbon slave briquette is sintered in a decarburizing atmosphere, whereas the 1.0 percent carbon is sintered in a carburizing atmosphere is because decarburizing atmosphere provides for better machinability, while the carburizing atmosphere will facilitate quench cracking.

Generally, whenever in excess of 0. percent carbon, by weight, is found in the briquetted slave preform 12, such will be sintered in a protective atmosphere. It also being understood that the higher the amount of carbon, the more extensive quench cracking occurs, thereby enhancing separation of the quenched slave preform.

Apart from the above characteristics, the slave preform 12 is to have the physical geometry to be easily cracked in response to quenching. In addition, it is important that the physical geometry be such as to provide the strength necessary for the slave preform to resist failure resulting from any of the conditions occuring during the conventional forging steps contemplated by the present invention.

Towards the particular end of facilitating quench cracking of the slave preform 12, it will be appreciated, of course, that the powder metal material and carbon content are appropriately selected in accord with known techniques not forming a part of the invention. With the slave preform 12 quench cracked, it can be more easily removed or separated from the primary preform 10.

Primary preform member 10 forms the inner bearing component 14. FIGS. 1A to 1F, as noted, clearly disclose the steps followed in practice of the invention for use in formation of an inner bearing race member 14 with external recess or raceway 16. Primary preform 10 is also made of a suitable metal, preferably, powdered metal. The primary preform 10 is case hardened, in a manner to be described, to provide for a long operational life and to an extent to prevent the primary preform 10 from cracking when it is quenched with the slave preform 12. It is also envisioned that the exterior surface of primary preform 10 need not be case hardened. If such is the case, the primary preform is made of a metal which resists quench cracking whenever the slave preform is quenched in the manner to be described and the primary preform can be subsequently carburized. However, if powdered metal is to be used, case hardening is desirable. The powdered metal primary preform 10 should resist quench cracking, possess sufficient strength to avoid cracking or crumbling during forging, as well as facilitate the desired preselected deformation of the primary preform 10 to form the inner bearing member 14. Such powdered metal can be comprised of iron powder or a low alloy steel powder being the equivalent of the 1000 to 4600 wrought steel series, respectively. This type of powdered low alloy steel and the iron powder can have suitable amounts of carbon added thereto.

A blend of powdered metal and carbon is usable in the fabrication of the primary preform 10 and is suitably briquetted in a pressing step to a semi-finished product or preform having low density. The briquetting of the primary preform 10 is accomplished in standard fashion and such briquetting does not form an aspect of this invention.

Subsequent to the above operation, the briquetted powder metal preform 10 is subjected to known sintering and carburizing steps. The sintering and carburizing steps are performed in a known way to achieve, inter alia, a case hardened surface 22. It is evident that the conditions under which the known sintering-carburizing steps are performed are appropriately selected in accordance with known procedures to achieve the desired properties. A more detailed description of the sintering and carburizing steps are given below.

The foregoing is accomplished in a known sintering furnace having a known carburizing apparatus and treating conditions. An example of such a sinter-carburizing step, as contemplated for use, is generally described in U.S. Pat. No. 3,992,763, which is assigned to the assignee of the present invention. The above steps can, in known fashion, ensure attainment of a primary preform having the chemical and physical properties thought desirable for the bearing member 14.

For example, the case hardened surface 22 of bearing 14 is between about 0.85 percent to 0.95 percent carbon by weight, whereas the bearing core 24 could have between about 0.22 percent to 0.28 percent carbon by weight. The sinter-carburizing is performed until the case of the primary preform has the desired carbon level to produce about between 60 and 64 Rc. when quenched and attains the desired depth necessary for the purposes intended for the particular bearing member.

Figure 1B:
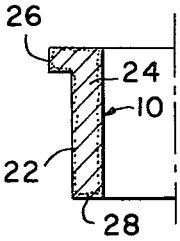
FIG. 1B is a partial cross-sectional view of a generally annular primary preform member.
Figure 1C:
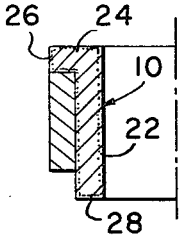
FIG. 1C is a view depicting the slave and primary preform members of FIGS. 1A and 1B, respectively, in an assembled condition prior to forging.
Figure 1D:
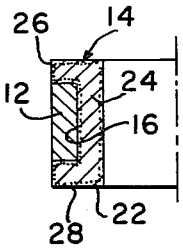
FIG. 1D is a partial cross-sectional view depicting the relationship of the primary and slave preform members after the forging operation, whereby the primary preform member is deformed about the slave preform member, to form a generally vertical and external recess.
Figure 2A:
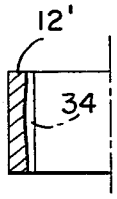
FIG. 2A is a partial cross-sectional view of a generally annular slave preform made in accordance with the principles of the present invention.

As best viewed in FIGS. 1B and 1C, the annular primary preform 10 is briquetted with an outwardly extending flange 26. Flange 26 not only supports the slave preform 12 prior to and during forging, but also forms a sidewall for the recess 16. The end portion 28 of the preform 10 is dimensioned to protrude from the slave preform such that, in conjunction with the slave preform 12, it will, whenever forged, be contacted and deformed. The end result of such deformation is perhaps best depicted in FIG. 1D. As observed, end portion 28 is deformed during forging to form the opposing sidewall of recess 16.

Figure 1E:
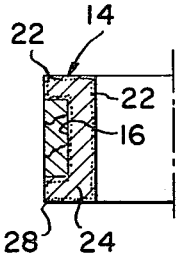
FIG. 1E is a partial cross-sectional view illustrating the cracking of the slave preform member during a quenching operation.
Figure 1F:
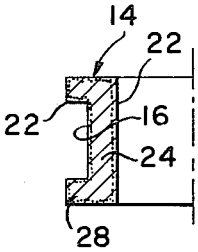
FIG. 1F is a partial cross-sectional view representing the forged primary preformed member without the slave preform.
Figure 1G:
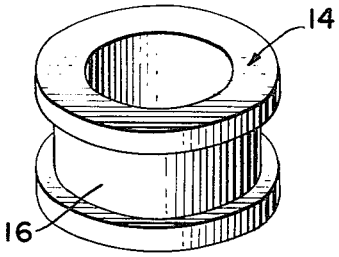
FIG. 1G is a perspective view illustrating the fact that the forged primary preform has been formed into an inner bearing race member by virtue of the foregoing sequential steps shown in FIGS. 1A through 1F.

With reference to FIG. 1E, it is seen that slave preform 12 is disposed adjacent and in contact with flange 26 prior to the forging step. In practice of the invention, the slave preform 12 ordinarily has a slight press-fit with the primary preform 10.

Either or both of the preforms 10 and 12 can be suitably coated with an appropriate lubricant. This is done to prevent the adjoining surfaces of the preforms from adhering together. The lubricant tends to prevent the primary preform 10 and slave preform 12 from being welded or bonded together during the forging operation. Should such a welding action occur, however, the case hardened surface of the primary preform is detrimentally affected. Furthermore, removal of the slave preform 10 is complicated. It is, therefore, important that the kind of lubricant used prevent the above-described welding condition. It will be understood that impairment of the case hardened surface 22 on the primary preform 10 will not occur. In addition, separation of the slave preform 12 is facilitated.

Towards the foregoing end, the lubricant material is appropriately selected to possess properties which will effectuate the foregoing goal of preventing the welding of the slave and primary preforms during the forging operations. It being understood that the selection of lubricant materials is again made consistent with known engineering practice to ensure prevention of welding.

It has been determined that a water base, fine graphite suspension type lubricant works quite well.

In accordance with the invention, the assembled preforms 10 and 12 are suitably placed into the die of a known hot forging system, such as described in the aforementioned U.S. Pat. No. 3,992,763 and its related U.S. Pat. No. 4,002,471, which is also assigned to the Assignee of the present invention.

Both preforms 10 and 12 are further compacted during forging to a more dense state, wherein the deformed primary preform has its desired dimension. Mention is also made that both the primary and slave preforms 10 and 12, respectively, when forged in the hot-forge system are generally below the die or core rod surface. As mentioned above, previously attempted forging efforts to form generally axial recesses in forged members have been unsuccessful because of interference of the die surface or core rod.

After the forging step, both the primary and slave preforms 10 and 12 have had their cross-sectional area appropriately reduced and are then suitably removed from the forge die. Thereafter, both the preforms are subjected to the quenching step. As somewhat exaggerated for the purposes of illustration, FIG. 1E depicts the slave preform 12 in a cracked condition as a result of the quench cracking step.

The particular fluidic quenching medium, as well as the temperature of such medium and the prescribed time interval necessary to achieve the quench cracking is determined in accordance with sound engineering practice. Of course, the parameters of the quenching condition can be suitably varied. In this connection, the present invention contemplates the application of any suitable oil quenching medium, such as disclosed in the aforementioned U.S. Pat. Nos. 3,992,763 and 4,002,471.

However, the present invention envisages that the primary preform 10 be fabricated from a material and treated in a fashion to avoid having the forged primary preform member 10 quench cracked along with the slave preform. A powdered metal primary preform properly carburized during the sintering operation will not quench crack when forged and quenched.

After the slave preform 12 is quench cracked, it is removed from the formed primary preform 10. The removal step may be expeditiously and simply accomplished by any conventional approach. For instance, if the slave preform 12 has no carbon, it is removed by machining, whereas if relatively high amounts of carbon are present, the cracked slave preform can be removed by appropriate and conventional mechanical breaking techniques.

The quenching causes sufficient cracking which enables application of other suitable and conventional techniques which completely remove the cracked slave preform 12 from recess 16 formed in the resulting inner bearing member 14. The resulting recess 16 is completely ready for the purposes intended following a finish grind if surface finishes in the area of 0–50 microinches are required. Surface finishes of 125 microfinishes are easily obtainable with applicant's invention and applicant can obtain surface finishes as good as 60 microinches providing good lubrication procedures are followed with respect to the preforms. These other removal or separation techniques vary from machining, such as when virtually little cracking occurs, to mechanical breaking of the slave preform 12 by suitable implements when a significant quench crackable slave preform is used. In the later instance, the slave preform may be sufficiently cracked that it simply falls off to the bottom of the quenching bath. The foregoing list of separation techniques for slave preform 12 is for purposes of illustration and not limitation. Since lubricant is used, the case hardened surface 22 is not adversely affected by the slave preform 12, and the latter's extrication is facilitated.

It will be appreciated that by virtue of the foregoing sequence of steps utilizing the slave preform 12, only a single forging step is needed to form inner bearing member 14 having external axial recess 16.

In regard to the sequence of steps shown in FIGS. 2A through 2G, it will be appreciated that such depict the use of primary and slave preforms 10' and 12' for use in forming outer bearing member 30 with internal generally axial recess 32. It being understood that the primary difference between this embodiment and the earlier described embodiment is the fact that the slave and primary preforms 10' and 12' are used for the successful completion of an outer bearing race member 30 having an internal recess. The difference in the operational steps is, of course, the fact that the press-fit placement of the primary preform 10' is radially outwardly disposed with respect to the slave preform 12'. In the other embodiment, the slave preform was disposed exteriorly with respect to the primary preform. Slave preform 12' is supported by the outer annular flange 26' to maintain it in the desired position during forging. In this embodiment, grooves 34 function to even better effectuate the quench cracking of the slave preform 12'.

It will be understood that the formation steps for the slave and primary preforms are essentially the same as in the above embodiment. In addition, the materials for fabricating the preforms can be the same, as well as the forging, quenching and separating steps. Hence, a detailed description has been dispensed with.

Figure 3:
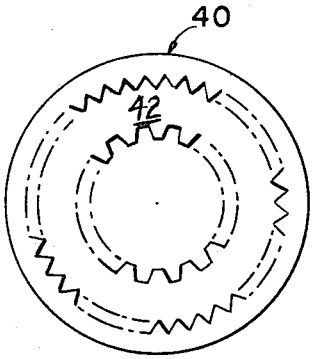
FIGS. 3, 4 and 5 represent forged gear members having a recessed area formed from a corresponding slave preform being of a shape and dimension such that it can form the noted recessed areas.
Figure 4:
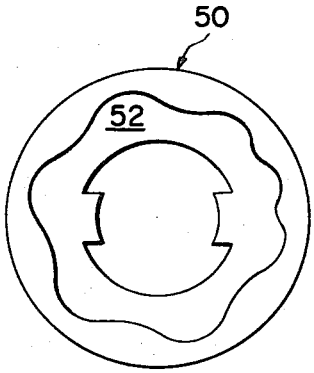
Figure 5:
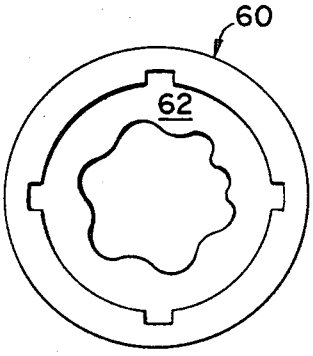

Reference is now made to FIGS. 3, 4 and 5 where there are depicted powder metal gearing members 40, 50 and 60, each having a centrally formed opening and recessed area 42, 52 and 62, respectively. Recessed areas 42, 52 and 62 are formed during a suitable and conventional forging operation, such as in the noted hot-forge system, in which a correspondingly and complementary shaped slave preform (not shown) has been utilized to form such recesses. The foregoing examples of different recessed configurations demonstrate that the present invention contemplates that the slave preform can produce a wide variety of recesses on other than formed bearing members. As with the other described embodiments, it is desirable to have the slave preforms made of powdered metal material. In addition, of course, suitable lubricants coat either and, preferably, both of the preforms to avoid the welding or bonding together of such preforms whenever forged. Similarly, these slave preforms may have grooves or other indentations which will function to enhance the quench cracking.

Figure 6A:
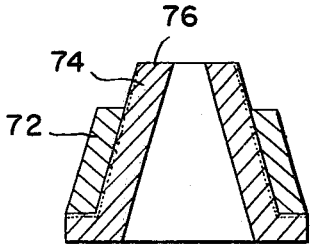
FIG. 6A is a cross-sectional view depicting a generally annular slave preform member in engagement with a primary preform member prior to a forging operation.
Figure 6B:
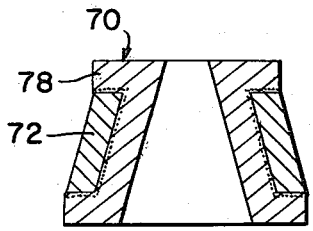
FIG. 6B illustrates the cooperation between the slave and primary preform members after the forging operation whereby the primary preform member has been deformed to an extent determined by the slave preform member.

Now referring to FIGS. 6A and 6B, there are only shown two operational steps in the formation of a cone bearing member 70. The steps for its formation are substantially the same as described earlier in connection with bearing members 14 and 30. The differences, of course, primarily relate to the fact that both slave and primary preforms 72 and 74, respectively, have been briquetted with different configurations. These configurations enable formation of cone bearing member 70. It will be seen that slave preform 72 has a suitable press-fit with the exterior tapered surface of the primary preform 74. The cone bearing preform 70 has its upper portion 76 formed with suitable dimension to ensure the formation of top flange member 78 during forging. As will be appreciated, the materials, the briquetting, sintering, carburizing, forging, quenching and separating steps, as well as lubricant, are appropriately selected to achieve the formation of the outer cone bearing.

The invention will be further described in connection with the following examples which are set forth for purposes of illustrating the present invention.

EXAMPLE 1

A slave preform is made of an appropriate iron powder material of the type utilized in the formation of powder metal parts. Added to the iron powder is a relatively high amount of carbon having 1.0 percent carbon, by weight. This carbon material is applied in the form of, for example, graphite. The blend of iron powder and carbon are briquetted at sufficient pressure to compress it into a semi-finished, low-density slave preform. The briquetting operation forms the annular shaped part having an inside diameter of about 3.30 inches and an outside diameter of about 3.53 inches, with a height of about 1.00 inches. Such dimension is sufficient to withstand failure during forging and enable formation of the recess on the forged primary preform, as well as facilitates quench cracking. The noted physical dimensions are such that it can be slightly press-fit onto the corresponding radially outer surface of the annular primary preform for purposes of effectuating formation of an external recess.

The primary preform is made of a powdered low alloy steel which is a powdered metal equivalent of the AISI 4600 wrought steel series. This preform has a carbon level in the range of 0.22 percent by weight. The foregoing materials are pressed or briquetted into a semi-final primary preform having a density of about 80 percent that of a fully dense part. The briquetted primary preform also has a generally annular configuration which has an inner diameter of 2.50 inches and an outer diameter of 3.30 inches and a height of 1.60 inches. In addition, the primary preform is briquetted with an annular flange adjacent one end such as shown in FIG. 1B to thereby receive the slave preform which is press-fit thereabout.

After completion of the briquetting operation, the preform is successively subjected to a combined sintering and carburizing process of the type described in said U.S. Pat. No. 3,992,763. In this process, the primary preform is simultaneously sintered and carburized in a sintering furnace equipped with the utilities and controls necessary to provide a carburizing atmosphere. In the sintering and carburizing process, the temperature is about 2050° F. endothermic carburizing gas is utilized at about 2700 $ft^3$/hr. The sintering and carburizing operation is performed for a time interval of 45 min. with the sintering being performed at 2050° F. for about 25 minutes and the subsequent carburizing at 1700° F. for the remainder of the operation. As a result of the foregoing parameters being used, the surface is carburized and has 0.75–0.90 percent carbon by weight. The total carburized depth is approximately 0.080 inches. The remaining core of the primary preform has about 0.22 percent carbon, by weight.

Subsequent to the sintering and carburizing step, both the primary and slave preforms, respectively, are coated with lubricant. This prevents the preforms from being welded together during forging. The lubricant is a water base, fine graphite suspension.

Thereafter, the assembled preforms are suitably placed in a conventional hot-forge system. Under the hot-forge process, preferred by applicant, the operating temperature is about 1750° F. and the pressure applied to the assembled preforms is about 75 Tsi. As a result of the forging, both preforms have their cross-sectional areas further compressed such that the forged primary preform has the desired dimension and density.

After the forging, both the primary and slave preforms are quenched in an oil bath at approximately 1600° F. for a period of about 90 seconds. Under these conditions, the quench cracking of the slave preform is effectuated.

At the completion of the quenching, the cracked slave preform is easily removed from the forged inner bearing by any suitable mechanical breaking technique, such as by a sharp blow with a hammer or vibrator-type impact tool in the cracked areas.

EXAMPLE 2

In this example, the slave preform briquette is formed of iron powder material without carbon. As a result of the briquetting operation, the slave preform is formed. After the briquetting, it is sintered in a low carbon atmosphere as opposed to a carburizing atmosphere. This accomplishes a machinable material. The outside diameter of the preform is about 3.75 inches, the inner diameter is about 3.50 inches, and the height is about 1.00 inches. The physical dimensions of the slave preform are such as to enable it to be press-fit with the interior surface of the annular primary preform and to facilitate process handling as well as withstand forging.

Figure 2B:
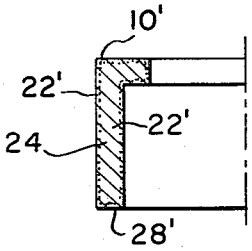
FIG. 2B illustrates a partial cross-sectional view of a generally annular primary preform member used in forming an outer bearing race member.

The primary preform is briquetted, in the configuration shown in FIG. 2B, from the same low alloy steel powder as in example 1, but has 0.22 to 0.28 percent carbon by weight. The briquetted preform has an outer diameter of about 4.25 inches, an inner diameter of about 3.75 inches, and a height of about 1.60 inches. The noted sintering and carburizing process is performed. Such process case carburizes the exterior of the primary preform. In this sintering and carburizing process, the temperatures are the same as Example 1, 2050° F., endothermic carburizing gas is utilized in about 2700 $ft^3$/hr. for a time period of about 45 minutes. As a result of such parameters being followed, there is produced a case carburized surface having 0.75–0.95 percent carbon by weight and a core having 0.25 percent carbon by weight.

Figure 2C:
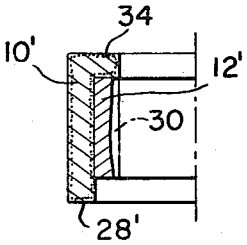
FIG. 2C is a view depicting the slave and primary preform members of FIGS. 2A and 2B, respectively, in an assembled position prior to a forging operation.
Figure 2D:
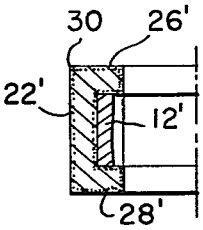
FIG. 2D is a partial cross-sectional view illustrating the arrangements of the slave and primary preform members after a forging operation whereby the primary preform member is deformed about the slave preform to form an internal and generally vertical recess.
Figure 2E:
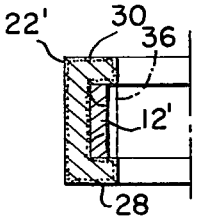
FIG. 2E is a partial cross-sectional view representing the cracking of the slave preform member during a quenching operation.
Figure 2F:
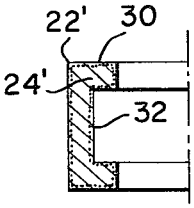
FIG. 2F represents a partial cross-sectional view showing the forged primary preform member without the slave preform member.
Figure 2G:
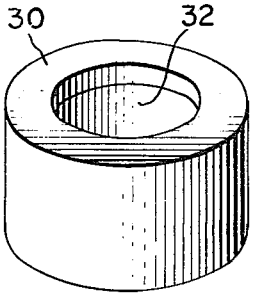
FIG. 2G is a perspective view illustrating the fact that the forged primary preform has been formed into an outer bearing race member formed generally by virtue of the foregoing sequential steps shown in FIGS. 2A through 2F.

After the sintering and carburizing step, the preforms coated with graphite lubricant and then assembled with the slave preform disposed radially inwardly relative to the primary preform much as in the manner depicted in FIG. 2C. Subsequent to the assembling step, the preforms are to be forged. The forging step taken on the assembled preforms of FIG. 2C results in the formation shown in FIG. 2D. The forging is accomplished in a known sinta-forge system.

In this sinta-forge process, the operating temperature is about 1750° F. and the pressure is about 75 Tsi.

After the forging, both the primary and slave preforms are quenched in an oil bath at 1600° F. for a period of about 90 seconds. Under these conditions, the slave preform can be machined off and the surfaces of the primary preform are carburized.

At the completion of the quenching, the cracked slave preform is easily removed from the forged inner bearing by any suitable machining technique.

EXAMPLE 3

In this example, the slave preform briquette is formed of powder material with 0.65 percent carbon by weight. After the briquetting, it is sintered in a carburizing atmosphere. The outer diameter is about 4.50 inches, the inner diameter about 4.25 inches, and the height about 1.00 inches. The slave preform is slightly press-fit interiorly of the annular primary preform.

The primary preform is briquetted, in the configuration shown in FIG. 2B, from low allow steel powder being the powdered equivalent of 4600 series, and has 0.25 percent carbon by weight. The briquetted preform has an outer diameter of about 4.75 inches, an inner diameter of about 1.50 inches, and a thickness of about 1.00 inches. The noted sintering and carburizing process is performed which case carburizes the exterior of the primary preform. The sintering and carburizing process is performed as in Example 1, the sintering temperature is about 2050° F., endothermic carburizing gas is utilized in about 2700 $ft^3$/hr. for a time period of about 45 minutes. The result of such parameters being followed produces a case carburized surface with a surface carbon of about 0.85 percent carbon, and a core having 0.28 percent carbon.

After the foregoing, graphite lubricant is applied to coat both the preforms. The coated preforms are then assembled together in the fashion shown in FIG. 2C. The assembled preforms are forged in the hot-forge system wherein the temperature is about 1750° F. and pressure is about 75 Tsi.

At the conclusion of the above, the forged preforms are quenched in an oil bath at approximately 1600° F. for a time interval of 90 seconds. Under these conditions, quench cracking of the slave preform results.

Thereafter, the quench cracked preform is removed from the outer bearing member by a sharp blow with a hammer or a vibrator-type impact tool in the cracked areas.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims. For example, an alternative could be a final product having a through hardened structure rather than a case (hard)/core (soft) structure. This would be accomplished by selecting a higher carbon content in the powder used for the fabrication of the primary preform and sintering the primary preform consistent with the aforementioned U.S. Pat. No. 4,002,471. Further, by using a 4600 type steel alloy powder with approximately 0.60–0.70 carbon by weight, sintering in a controlled atmosphere to maintain a combined carbon of 0.60–0.70 throughout said sintered preform, assembling the slave preforms as previously described, forging and quenching the assembled preforms as previously described, would result in a primary member having a uniform through hardened structure.

What is claimed is:

1. A method of forging preselected recessed surfaces in a member is disclosed which comprises the steps of adding a suitable lubricant material to at least a slave or primary preform member wherein the lubricant material is sufficient to prevent welding between the noted preforms during forging; joining the slave preform to the primary body preform member, followed by forging the joined together preforms such that the primary preform member is deformed to an extent generally complementary to a portion of the configuration of the slave preform, such that the forged primary preform has formed therein a shaped recess generally complementary to at least a portion of the configuration of the slave preform; quenching the forged slave and primary preforms subsequent to forging; and removing the quenched slave preform from the primary preform.

2. The method of claim 1 wherein said slave preform is formed from a quench crackable material.

3. The method of claim 2 wherein said quench crackable slave preform is fabricated with a multiplicity of spaced apart grooves formed on one surface thereof, said one surface being opposite to the surface adjacent the primary preform for facilitating quench cracking of said slave preform.

4. The method of claim 2 wherein said quench crackable slave preform is made of a briquetted, sintered, and carburized powdered metal.

5. The method of claim 4 wherein said powdered metal is comprised of iron powder and graphite, wherein said graphite, by weight, is sufficient to ensure quench cracking.

6. The method of claim 3 wherein said quench crackable slave preform comprises about between in excess of 0.0 percent by weight of carbon to 1.0 percent carbon by weight.

7. The method of claim 1 wherein said step of removing said slave preform is performed by mechanically breaking said slave preform.

8. The method of claim 7 wherein said slave preform is made of a briquetted and sintered metal powder wherein the sintering is conducted in a decarburizing atmosphere.

9. The method of claim 8 wherein said slave preform is comprised of iron powder without carbon in an amount sufficient to cause quench cracking thereof.

10. The method of claim 2 wherein said quench crackable slave preform has a physical geometry which promotes quench cracking and provides sufficient strength to withstand forging pressures.

11. The method of claim 1 wherein said primary preform is made of a briquetted and sintered metal powder.

12. The method of claim 11 wherein said primary preform has been sintered in a carburizing atmosphere so as to resist being quench cracked.

13. The method of claim 1 wherein said briquetted, sintered and carburized primary preform is case hardened to a preselected depth and a predetermined hardness.

14. The method of claim 13 wherein said briquetted sintered and carburized metal powder has a carbon level which produces a hardness between about 60 and 64 Rc.

15. The method of claim 14 wherein said case hardened surface has between about 0.85 percent carbon by weight to about 0.95 percent carbon by weight.

16. The method of claim 15 wherein said primary preform has a core with a carbon level beneath said case hardened surface between about 0.22 and 0.28 percent by weight.

17. The method of claim 16 wherein said primary preform is comprised of a low alloy steel powder.

18. The method of claim 17 wherein said powder is about the equivalent of the 1000 to 4600 wrought steel series.

19. The method of claim 1 comprising the preliminary step of coating both said primary and slave preforms with lubricant.

20. The method of claim 19 wherein said lubricant includes a water base and fine graphite suspension.

21. The method of claim 1 wherein said lubricant includes a water base and fine graphite suspension.

22. The method of forging a preselected recessed surface and a finished bearing member which comprises the steps of adding a suitable lubricant material to both slave and primary preform members wherein the slave preform is a briquetted and sintered powder metal part which is quench crackable when forged and quenched and the primary preform is a briquetted, sintered, and carburized metallic part, and wherein the lubricant is sufficient to prevent welding between the noted preforms during forging, press-fitting the slave preform to the primary body preform member, followed by forging the press-fit preforms such that the primary preform member is deformed to an extent generally complementary to a portion of the configuration of the slave preform, such that the forged primary preform has formed therein a shaped recess generally complementary to at least a portion of the configuration of the slave preform; quenching the forged slave and primary preforms subsequent to forging such that the slave preform is quench cracked; and removing the quenched slave preform from the primary preform by mechanical breaking.

23. A method of forging a preselected recessed surface and a finished bearing member which comprises the steps of coating a slave and a primary preform with a suitable lubricant material which prevents welding between the preforms during forging, the slave preform is a briquetted, sintered, and carburized powder metal part which is quench crackable when forged and quenched, said slave preform having a generally annular configuration, and the primary preform is a briquetted, sintered and carburized powder metal part having a generally annular configuration with a radially disposed flange, press-fitting the slave preform to the primary body preform member such that the slave preform rests on the flange, followed by forging the press-fit preforms such that the primary preform member is deformed to an extent generally complementary to a portion of the configuration of the slave preform, such that the forged primary preform has formed therein a shaped recess generally complementary to at least a portion of the configuration of the slave preform; quenching the forged slave and primary preforms subsequent to forging such that the slave preform is quench cracked; and removing the quenched and cracked slave preform from the primary preform by mechanical breaking.

24. The method of claim 23 comprising the preliminary steps of forming the slave preform comprising the sequential steps of:

briquetting the slave preform from the metal powder having a preselected carbon content throughout, sintering the slave preform at a controlled temperature, and carburizing the slave preform to substantially enable it to quench crack whenever quenched by providing a controlled carbon atmosphere of endothermic gas and maintaining the slave preform in a controlled atmosphere for a predetermined period of time.

25. The method of claim 24 comprising the preliminary steps of forming the primary preform comprising the sequential steps of:

briquetting the primary preform from the metal powder having a preselected initial carbon content throughout, the briquetted primary preform having at least one surface thereof which in the final forged form has a preselected case depth, sintering the slave preform at a controlled temperature, and carburizing the slave preform to substantially enable it to quench crack whenever quenched by providing a controlled carbon atmosphere of endothermic gas and maintaining the primary preform in a controlled atmosphere for a predetermined period of time to obtain a desired case depth having a final carbon content substantially greater than the initial carbon content of the case as well as the final carbon content of the inner core.

26. The process of claim 23 wherein said forged preforms are cooled by quenching in an oil bath for a preselected period of time.

27. A method as in claim 23 wherein said primary preform is briquetted from a metal powder having a preselected initial carbon content throughout, which is sufficient to enable said finished bearing member to be through hardened.

28. A method as in claim 27 wherein said slave preform is briquetted from 4600 type steel alloy powder having approximately 0.60–0.70% carbon by weight throughout, which is maintained during sintering in a controlled atmosphere.

* * * * *